US008959772B2

(12) United States Patent
Hernandez et al.

(10) Patent No.: US 8,959,772 B2
(45) Date of Patent: Feb. 24, 2015

(54) MULTIPOINT INJECTOR FOR TURBOMACHINE

(75) Inventors: Didier Hippolyte Hernandez, Quiers (FR); Thomas Olivier Marie Noel, Vincennes (FR)

(73) Assignee: SNECMA, Paris (FR)

( * ) Notice: Subject to any disclaimer, the term of this patent is extended or adjusted under 35 U.S.C. 154(b) by 421 days.

(21) Appl. No.: 13/428,932

(22) Filed: Mar. 23, 2012

(65) Prior Publication Data

US 2012/0186083 A1 Jul. 26, 2012

Related U.S. Application Data

(62) Division of application No. 12/185,451, filed on Aug. 4, 2008, now Pat. No. 8,186,163.

(30) Foreign Application Priority Data

Aug. 10, 2007 (FR) ..... 07 57025

(51) Int. Cl.

| | |
|---|---|
| ***B21K 1/20*** | (2006.01) |
| ***F23R 3/28*** | (2006.01) |
| ***F23D 11/36*** | (2006.01) |
| ***F23R 3/34*** | (2006.01) |

(52) U.S. Cl.

CPC ..... *F23R 3/283* (2013.01); *F23D 11/36* (2013.01); *F23R 3/343* (2013.01); *F23D 2900/00016* (2013.01)

USPC ..... 29/890.128; 29/890.124; 60/742; 60/748

(58) Field of Classification Search

CPC ..... B23P 15/001; B23P 19/10; B23P 19/04; F02M 61/168; F16K 27/041; F23D 17/002; F23R 3/36; F23R 3/286

USPC ..... 29/889.2, 890.124, 890.125, 890.126, 29/890.128, 890.132, 890.12, 463; 60/742, 748, 740, 746; 239/132.3, 239/132.5

See application file for complete search history.

(56) References Cited

U.S. PATENT DOCUMENTS

| | | | |
|---|---|---|---|
| 6,523,350 | B1 | 2/2003 | Mancini et al. |
| 2007/0157616 | A1 | 7/2007 | Hernandez et al. |
| 2007/0169486 | A1 | 7/2007 | Hernandez et al. |
| 2010/0115955 | A1 | 5/2010 | Goeke et al. |

FOREIGN PATENT DOCUMENTS

| | | | |
|---|---|---|---|
| EP | 1 806 536 | A1 | 7/2007 |

*Primary Examiner* — Ryan J Walters

(74) *Attorney, Agent, or Firm* — Oblon, Spivak, McClelland, Maier & Neustadt, L.L.P.

(57) ABSTRACT

A multipoint injector for a turbomachine according to which any risk of fuel coking is eliminated is disclosed. The multipoint fuel which is liable to stagnate inside the circuit thereof is cooled uniformly, due to the formation of continuous baffles which each communicate with at least one separate circulation channel and of which the peripheral baffles open out into a fuel admission chamber arranged in a zone diametrically opposing the circulation channels and which communicates with the injection nozzle for pilot fuel in order to achieve uniform supply and cooling of the injector.

2 Claims, 8 Drawing Sheets

MULTIPOINT INJECTOR FOR TURBOMACHINE

CROSS-REFERENCE TO RELATED APPLICATIONS

This application is a division of U.S. application Ser. No. 12/185,451 filed Aug. 4, 2008, the entire contents of which is incorporated herein by reference. U.S. application Ser. No. 12/185,451 is based upon and claims the benefit of priority from prior French Application No. 0757025 filed Aug. 10, 2007.

BACKGROUND OF THE INVENTION AND DESCRIPTION OF THE PRIOR ART

The invention relates to a multipoint injector intended to be mounted in an injection system fixed to a combustion chamber housing of a turbomachine, such as an aircraft engine. It relates more particularly to the structure of such an injector and, in particular, the part of the structure dedicated to supplying the pilot circuit and multipoint circuit and to the cooling thereof.

Fuel injectors known as "multipoint" fuel injectors are a new generation of injectors which make it possible to adapt to different speeds of the turbomachine. Each injector is provided with two fuel circuits: that known as the "pilot" circuit which has a continuous flow optimized for low speeds and that known as the "multipoint" circuit which has an intermittent flow optimized for high speeds. The multipoint circuit is used when it is necessary to have additional thrust from the engine, in particular in the cruising and take-off phases of the aircraft.

At raised temperatures, the intermittent operation of the multipoint circuit has the major drawback of causing decomposition, otherwise known as coking, of the fuel stagnating inside the multipoint circuit when the flow thereof is considerably reduced, or even cut off. To eliminate this risk of coking, it is known to use the fuel circulating in the pilot circuit as cooling fluid for the fuel stagnating in the multipoint circuit.

Unfortunately, until now, the structure of the existing multipoint injectors has been such that the two pilot and multipoint circuits overlap one another. More specifically, such overlapping does not allow the cooling to be achieved in a satisfactorily uniform manner.

SUMMARY OF THE INVENTION

The object of the invention is, therefore, to propose a new design of multipoint injector making it possible to obtain uniform cooling of the fuel stagnating inside the multipoint circuit.

To this end, the invention relates to a multipoint-type fuel injector, intended to be mounted in a combustion chamber injection system, comprising:

an arm for supplying fuel, a first ferrule comprising a part forming a connection in which is housed one end of the arm and one part forming a body which is open internally, having an external diameter, and perforated internally with channels for circulating fuel communicating with the supply arm, at least one swirler stage interlocked in the opening of the body of the first ferrule, a fuel injection nozzle housed in a part forming the hub of the swirler stage to inject fuel originating from the inside of the pilot circulation channels of the first ferrule toward the axis of the injection system, a second ferrule comprising a part forming a body which is open internally, having an external diameter and of which the periphery is perforated with multipoint injection channels to inject fuel toward the periphery of the injection system, an injector in which the bodies of the first and second ferrules are interlocked such that their internal openings and external diameters mutually overlap at least partially, defining a hollow volume comprising at least three concentric baffles communicating with the circulation channels, of which the central baffle opens out onto the multipoint injection channels and the other peripheral baffles are adapted to circulate fuel around the central baffle in order to cool the fuel supplying the multipoint injection channels, and then to supply the injection nozzle. According to the invention, the baffles are continuous and each communicate with at least one separate circulation channel, the peripheral baffles opening out into a fuel admission chamber arranged in a zone diametrically opposing the circulation channels and which communicates with the injection nozzle in order to achieve uniform supply and cooling of the injector.

By the term "arranged in a zone diametrically opposing the circulation channels" must be understood that the admission chamber is arranged on an angular section diametrically opposed to the angular section in which the circulation channels open out into the baffles. For example, when the injector comprises a single multipoint circulation channel, which extends opposite the supply arm, the admission chamber is arranged at least partially along the diameter of the ferrule passing through the multipoint circulation channel.

Thus, as a result of a concentric and continuous arrangement of the peripheral cooling baffles which open out opposite the inlet of the pilot fuel used as cooling fluid of the multipoint fuel, uniform cooling is ensured both by the length of circulation of the pilot fuel and by the exchange surfaces between the two pilot and multipoint circuits.

Moreover, with a continuous central baffle, the circulation of the multipoint fuel is uniform.

According to an advantageous embodiment, the first and second ferrules each consist of a one-piece machined part, with at least one part in the form of a first hollow cylindrical ring, the baffles being formed by said first hollow cylindrical ring and a second cylindrical ring housed inside and soldered to the first cylindrical ring and of which the base is perforated by channels opposite the multipoint channels, in order to control the cooling/supply rate, in the pilot injection channels. Until now, the baffles were made by machining, essentially by electroerosion, directly and partially in one of the two one-piece ferrules. More specifically, this direct machining in a one-piece part does not allow grooves of low height to be formed, i.e. baffles of low height. The sections of the baffles and thus of the circuits machined directly in one piece may thus be adapted according to the desired flow and velocity. Machining two hollow cylindrical rings of different section, then housing one thereof in the other and finally soldering them together makes it possible to obtain sections of very precise dimensions. Thus, it is possible to adapt said sections easily to the desired fuel flow and/or velocity. Moreover, conventional techniques of machining may be used without resorting to machining by electroerosion.

In other words, separating the external ring into two separate parts makes it possible to control the geometry of the baffles and thus the rate of cooling/supply of the pilot injection.

According to an advantageous embodiment, the admission chamber is formed in the first ferrule and communicates with the injection nozzle by means of a pipe not passing through the swirlers or any space separating them. Thus according to this embodiment, the pilot circuit is connected to the injection nozzle by means of the exterior of the injection head. This makes it possible to dispense with the perforation of additional channels in the swirlers as currently implemented. This also makes it possible to obtain further configurations of the multipoint injector with fine swirlers and/or swirlers of the multi-swirler type, i.e. with a plurality of swirler stages. More specifically, in these configurations of the injector, it is not possible to perforate the swirlers or to pass through a plurality of stages.

Preferably, the pipe is connected, on the one hand, to the part of the admission chamber opposite the part opening out from the peripheral baffles and, on the other hand, to the part of the hub of the stage of swirlers opposite and in communication with the housing of the injection nozzle.

Further preferably, the pipe is a tube bent in a U-shape, of which one of the branches connected to the hub of the stage of swirlers extends along the axis of the injection nozzle and the other of the branches connected in parallel to the admission chamber extending in parallel to the axis of the injection nozzle. Thus a connection is obtained which has a small spatial requirement and which does not prevent or hardly prevents the entry of air onto the swirlers. The use of a bent and soldered tube is furthermore easy to implement and cost-effective.

In order to supply individually the baffles, the injector may further comprise a one-piece part forming a fuel distributor, the distributor comprising:

- a body soldered inside the connection of the first ferrule and perforated by at least two separate channels each communicating, on the one hand, with the inside of the arm connected to the pilot supply circuit and, on the other hand, with at least one pilot circulation channel perforated in the first ferrule;
- a duct which extends inside the arm and which is connected, on the one hand, to the multipoint supply channel and, on the other hand, to a multipoint circulation channel perforated in the first ferrule.

Preferably, the body of the distributor is perforated by four separate channels, two thereof each communicating with a pilot circulation channel of the first ferrule, itself opening out onto the external peripheral baffle and of which the two further baffles each communicate with a pilot circulation channel of the first ferrule, itself opening onto the internal peripheral baffle.

According to a variant, the swirlers of each stage are swirlers arranged in a helical manner relative to the axis of the injector and of uniform thickness over the width of the stage.

As a result of the invention, it is further possible to implement any thickness of swirler.

According to a further variant, there are two stages of swirlers interlocked with said peripheral stage, itself interlocked in the internal opening of the second ferrule.

The invention also relates to a combustion chamber for a turbomachine comprising at least one multipoint injector as disclosed above.

The invention also relates to a turbomachine comprising a combustion chamber to which an injector is fixed as disclosed above, mounted in an injection system, itself fixed to the combustion chamber.

The invention also relates to a method of manufacturing a ferrule intended to be assembled in a multipoint fuel injector, according to which multipoint injection channels are perforated on the periphery of the ferrule, characterized in that the following steps are implemented:

- machining a first one-piece part in order to obtain a large hollow cylindrical ring;
- machining a second one-piece part in order to obtain a small cylindrical ring of dimensions adapted to be housed inside the large hollow cylindrical ring;
- sealed soldering between the two bases of the rings;
- simultaneous perforation of the two rings soldered to one another in order to obtain multipoint injection channels.

Such a method which uses soldering of two one-piece parts to one another and the previous machining thereof makes it possible, therefore, to create sections of the cooling circuit of the multipoint fuel which are of dimensions which may be easily controlled.

The invention finally relates to a method of manufacturing a multipoint fuel injector comprising a first ferrule and a second ferrule manufactured as above, characterized in that the following steps are implemented:

- production of a one-piece part comprising a large solid cylindrical ring and a small solid cylindrical ring projecting axially relative to the large ring;
- perforation of pilot and multipoint circulation channels in the solid cylindrical rings;
- machining of the diameters of the solid cylindrical rings, perforated in order to obtain the first ferrule;
- interlocking of the first ferrule in the second ferrule so as to achieve overlapping both between the large, solid and hollow rings and between the small, solid and hollow rings;
- sealed soldering of the rings to one another.

DESCRIPTION OF THE DRAWINGS

Further advantages and features will emerge more clearly from reading the detailed description given below by way of indication and made with reference to the following figures.

DESCRIPTION OF THE PREFERRED EMBODIMENTS

Figure 1:
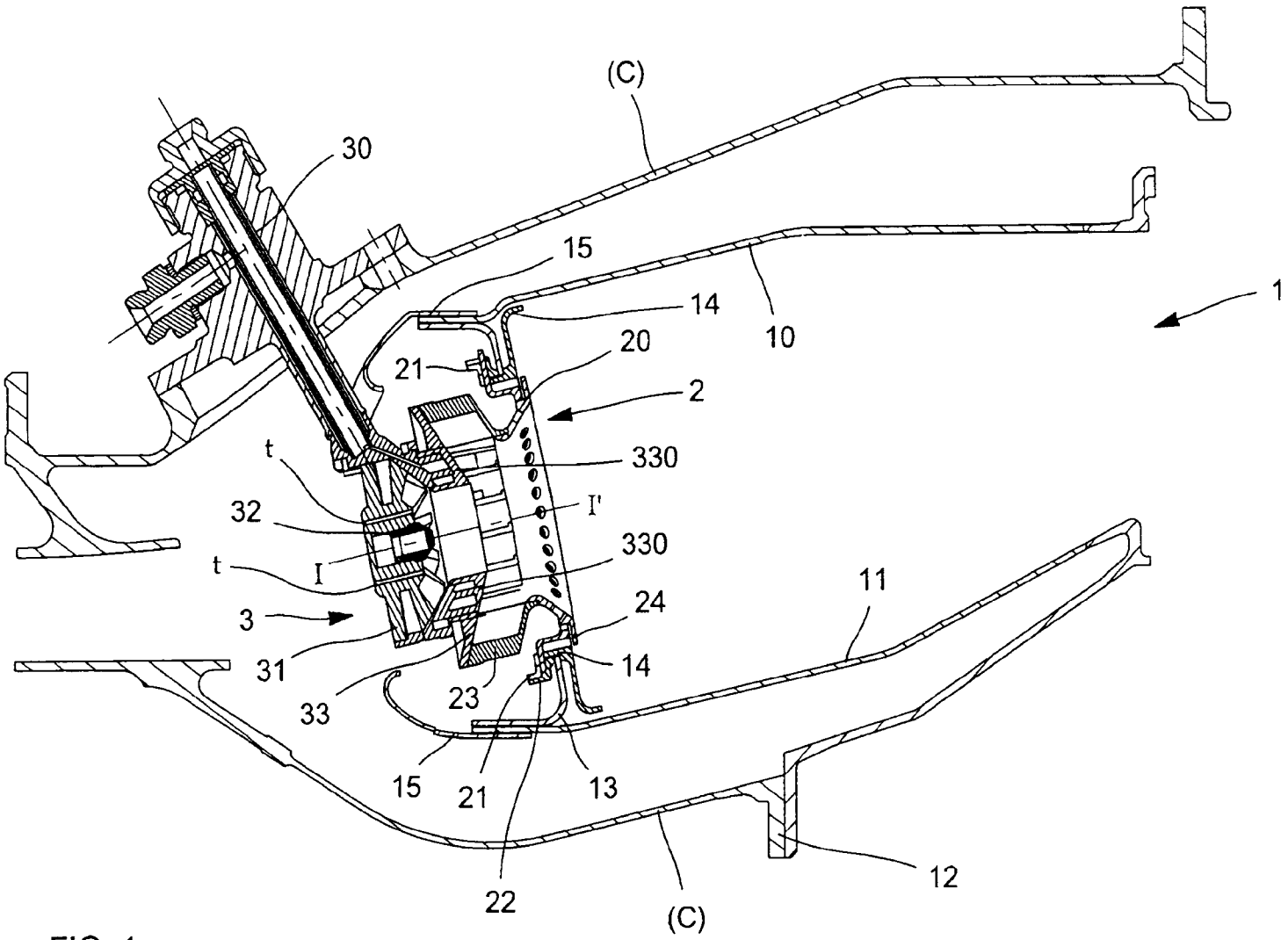
FIG. 1 is a general view in longitudinal section of a part of the combustion chamber of a turbomachine which shows the installation of a multipoint injector.

A part of the combustion chamber 1 of a turbomachine is shown in FIG. 1. The combustion chamber 1 usually comprises an external wall 10, an internal wall 11, flanges for fastening the internal 10 and external 11 walls (not shown) to the chamber housing C in a junction zone 12, a chamber base 13 bolted or welded to the walls 10, 11, a deflector 14 to protect the chamber base 13 from the radiation of flames as a result of the combustion, various one-piece or separate fairings 15 and finally a plurality of injection systems 2 in each of which is mounted an injector 3. In FIG. 1 only one injection system 2 with one injector 3 is shown: a revolving combustion chamber usually comprises a large number of injectors 3, generally from 10 to 50, the number depending on the power of the engine to be supplied. Each injection system 2 comprises a bowl 20 diverging toward the inside of the chamber to cause the emerging jet of the air and fuel mixture to ignite, a floating ring 21 for sliding the bowl 20 in the anchoring sleeve 22, one or more swirlers 23 making it possible to introduce air with a gyrating movement, a flange 24 cooled by air for thermally protecting the fastening system.

Each multipoint injector 3 essentially comprises an arm for supplying fuel 30, one or more swirler stages 31 permitting, as do the swirlers 23 of the injection system, air to be introduced with a gyrating movement, a fuel injection nozzle 32 positioned on the axis I-I' of the injector 3 and a network 33 of n fuel injection orifices 330 perforated on the periphery of the injector 3 (FIG. 1). Each injector 3 is fixed to the chamber housing 10 and is mounted in an injection system 2 disclosed above. More specifically, the supply arm 30 is fixed to the housing 10 in such a manner that the network 33 of injection orifices 330 is mounted in the upstream part of the swirler body 23 (FIG. 1). The assembly is thus implemented such that there is a precise centering (and thus a concentricity) between the injector 3 and its associated injection system 2. If required, a multipoint injector 3 comprises one or more purge holes t making it possible to introduce air axially into the injection system 2.

A multipoint injector 3 is thus designed to have, on the one hand, a fuel injection nozzle 32 arranged along its axis which injects fuel at a constant rate, generally optimized for low engine speeds and, on the other hand, multipoint orifices 330 perforated on the periphery of the injector and which inject fuel at an intermittent rate for high engine speeds, for example those required during take off of an aircraft equipped with the engine. In current designs, as explained below, the fuel circuit provided to supply the injection nozzle 32 and denoted "pilot circuit" is also used to cool the fuel circuit provided to supply the multipoint orifices 330 and denoted "multipoint circuit". More specifically, since this multipoint circuit is intended to provide fuel intermittently, fuel stagnates inside said circuit and a risk of coking or fouling of this stagnating fuel remains. Cooling the multipoint circuit continuously by the pilot circuit has, therefore, the purpose of avoiding any risk of fuel coking.

Figure 2A:
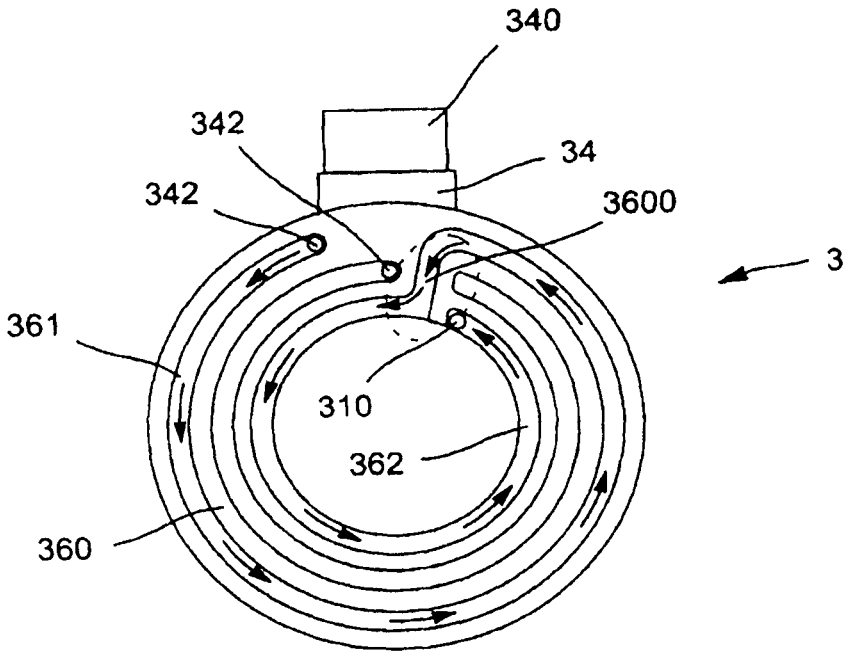
FIG. 2A PRIOR ART
FIGS. 2A and 2B are rear views in transverse section each showing a separate variation for circulating fuel inside a multipoint injector according to the prior art.

As currently implemented (FIGS. 2A to 2C), a multipoint injector 3 firstly comprises an arm for supplying fuel. It also comprises a first ferrule 34 comprising a part forming a connection 340 to house one end of the arm and one part forming a body which is open internally, having an external diameter, and perforated internally with channels 342 for circulating fuel communicating with the supply arm. At least one swirler stage 31 is interlocked in the opening of the body of the first ferrule. A fuel injection nozzle 32 is housed in one part forming the hub 310 of the swirler stage 31 to inject fuel originating from the inside of the circulation channels 342 of the first ferrule toward the axis I of the injection system. The injector 3 finally comprises a second ferrule 35 which comprises a part forming a body 350 which is open internally, having an external diameter and of which the periphery is perforated with multipoint channels 351 to inject fuel toward the periphery of the injection system. The outlet orifices of the multipoint channels 351 form the multipoint network of the injector.

Figure 2B:
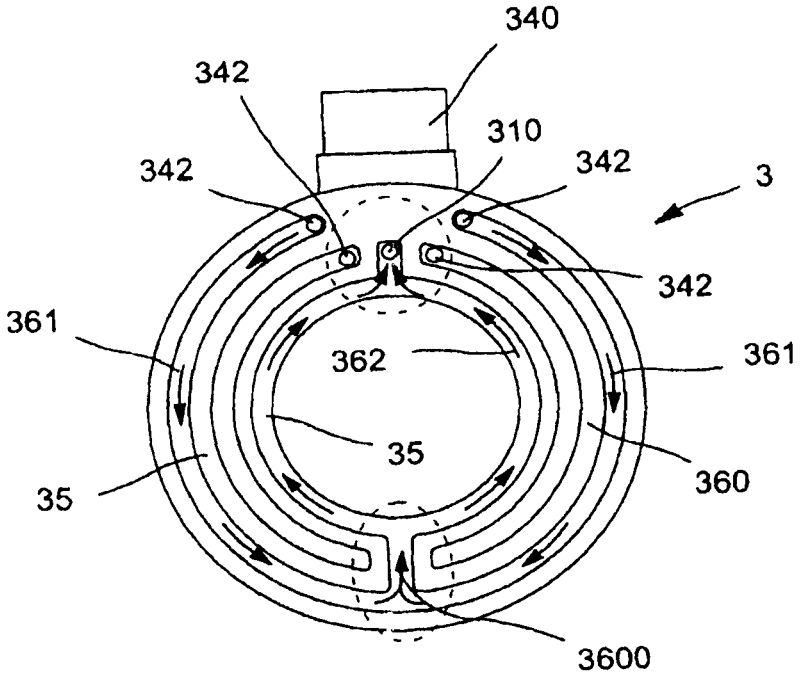
FIG. 2B PRIOR ART
Figure 2C:
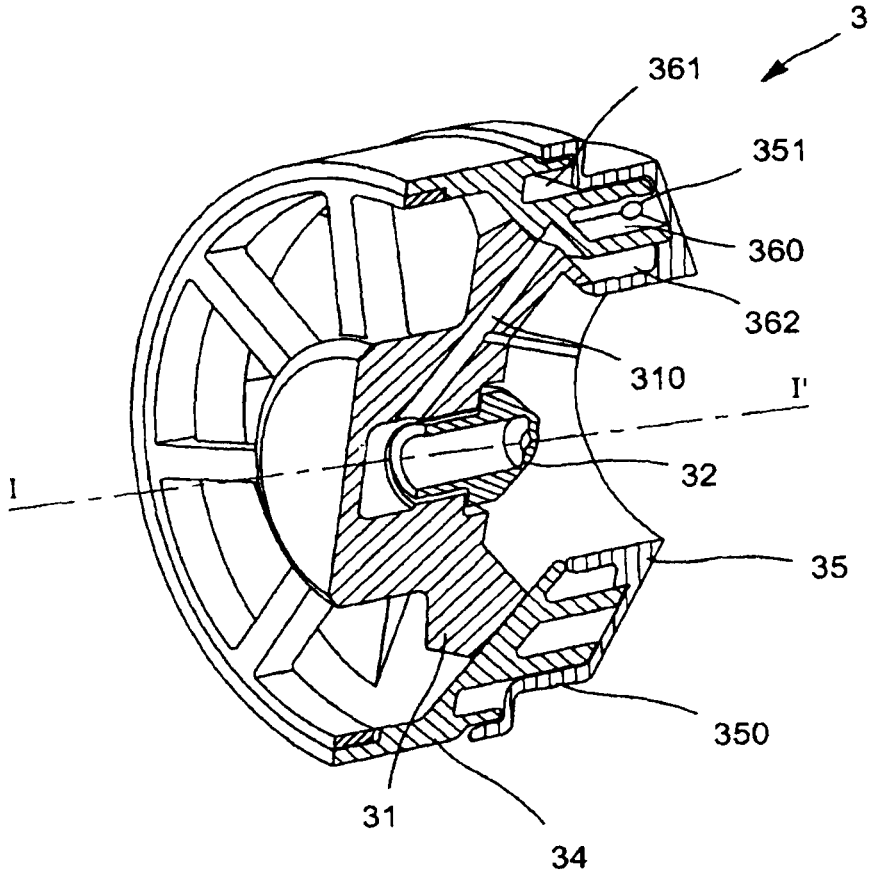
FIG. 2C PRIOR ART
FIG. 2C is a perspective view in longitudinal section of part of the injector according to the prior art.

As currently implemented, the bodies of the first 34 and second 35 ferrules are interlocked such that their internal openings and external diameters mutually overlap at least partially. Their overlapping defines a hollow volume comprising at least three concentric baffles of which the central baffle 360 opens out onto the multipoint channels 351 and the other peripheral baffles 361, 362 are adapted to circulate fuel around the central baffle 360 in order to cool the fuel supplying the multipoint channels 351, and then in order to supply the injection nozzle 32 (FIG. 2C). In other words, in this current design, the baffles 361, 362 of the pilot fuel circuit are arranged concentrically with said central baffle 360 of the multipoint circuit in order to cool said multipoint circuit in the most efficient manner and thus to avoid any risk of coking.

However, with the current design (FIGS. 2A and 2B), the central baffle 360 is discontinuous, the peripheral baffles 361, 362 communicate with one another by means of the discontinuity 3600 formed in the central baffle 360, and the internal peripheral baffle 362 does not communicate with the circulation channels 342 perforated in the body of the first ferrule 34. More specifically, only the external peripheral baffle 361 communicates with a circulation channel 342 (FIG. 2A) or two circulation channels 342 (FIG. 2B). Thus, the pilot fuel circulates inside the peripheral internal baffle 362 arriving from the circulation channel(s) 342 initially inside the external peripheral baffle 361, and then by passing through the discontinuity 3600. The arrows, shown in FIGS. 2A and 2B, inside two peripheral cavities 361, 362, thus indicate the path of the pilot fuel before its circulation in the admission channel 310 perforated inside the swirler stage 31. The pilot fuel circulating in the admission channel 310 arrives in the injection nozzle 32 (FIG. 2C).

Thus, the current structure of a multipoint injector 3 does not allow perfect uniformity to be achieved in the cooling of the multipoint fuel circulating in the central baffle 360. More specifically, the pilot fuel circulates either by following a spiral path (FIG. 2A) or by following two semi-circular concentric paths (FIG. 2B). This circulation thus creates non-uniform cooling zones both by means of the exchange surfaces between the pilot fuel and the multipoint fuel and by the circulation thereof. These non-uniform cooling zones, symbolically represented by dotted ellipses in FIGS. 2A and 2B, do not completely eliminate the risk of coking of the fuel stagnating in the central baffle 360 of the multipoint circuit.

According to the invention, completely uniform cooling of the multipoint fuel circuit is obtained by means of the fuel circuit. To achieve this, on the one hand, the three concentric baffles 360, 361, 362 are continuous over their entire circumference (FIGS. 3 and 3A) and they each communicate with at least one separate circulation channel 342 (FIG. 3C, FIGS. 3D and 3E). On the other hand, the peripheral baffles 361, 362 open out into a fuel admission chamber 37 diametrically opposing the circulation channels 342 and which communicates with the injection nozzle 32 (FIG. 3B).

Thus the baffles 360, 361, 362 both of the pilot fuel circuit and of the multipoint fuel circuit are concentric solid rings, resulting in the uniform cooling. In other words, the baffles 360, 361, 362 do not communicate with one another, which simplifies their geometry. Thus it is possible to produce said baffles by conventional machining.

Figure 3:
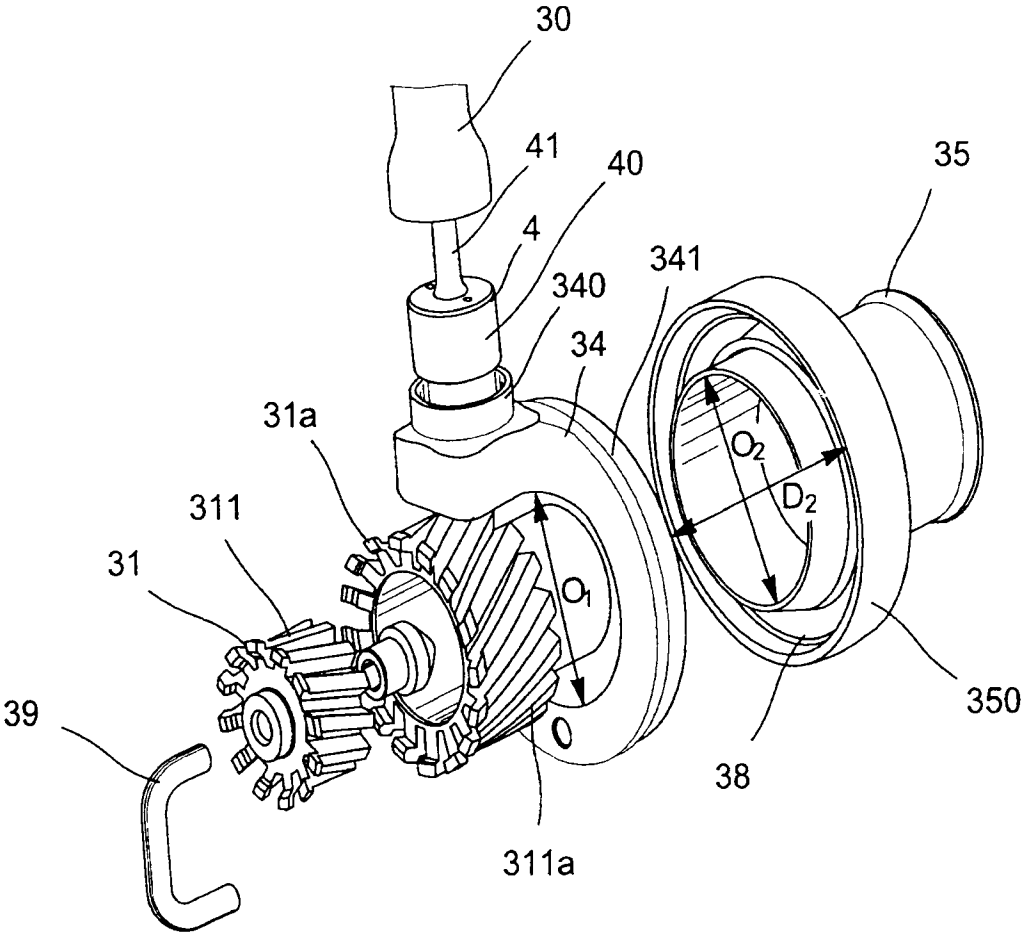
FIG. 3 is an external exploded perspective view of an embodiment of a multipoint injector according to the invention.
Figure 3A:
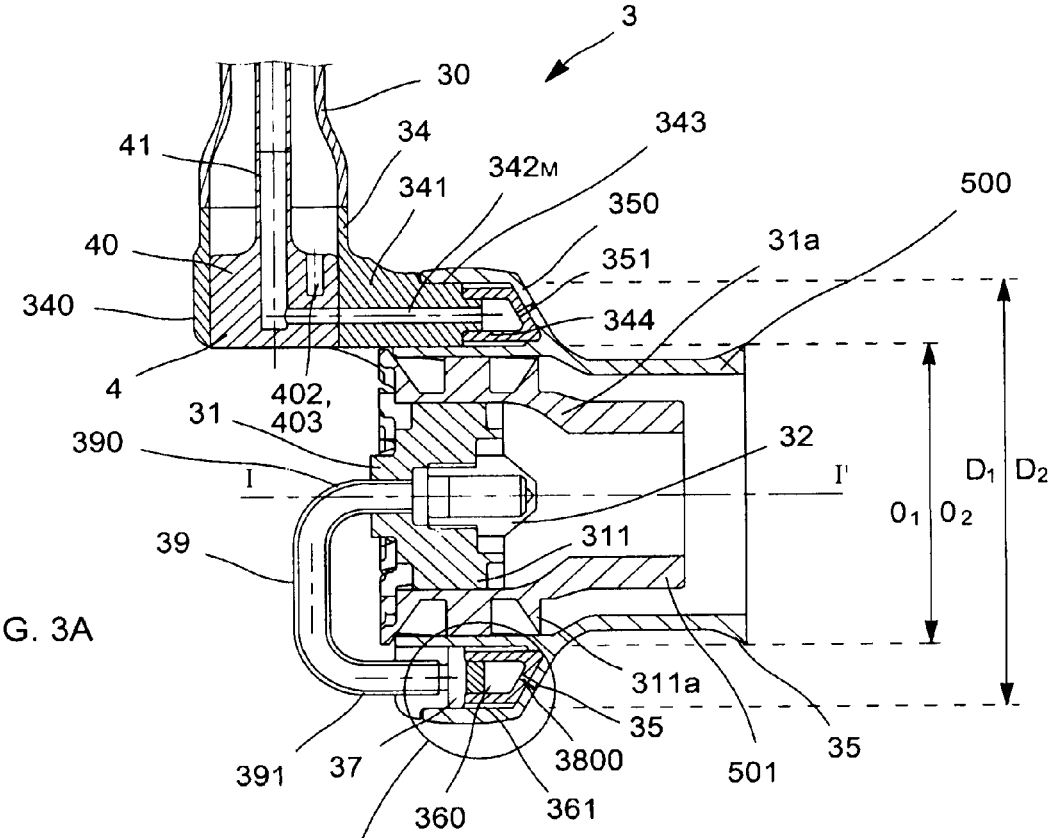
FIG. 3A is a view in longitudinal section of the injector according to FIG. 3.
Figure 3B:
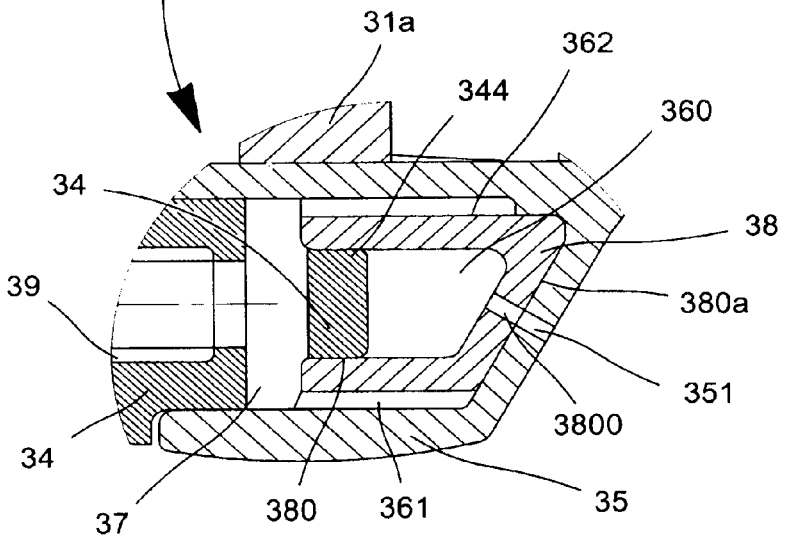
FIG. 3B is an enlarged view of part of the injector according to FIG. 3A.
Figure 3C:
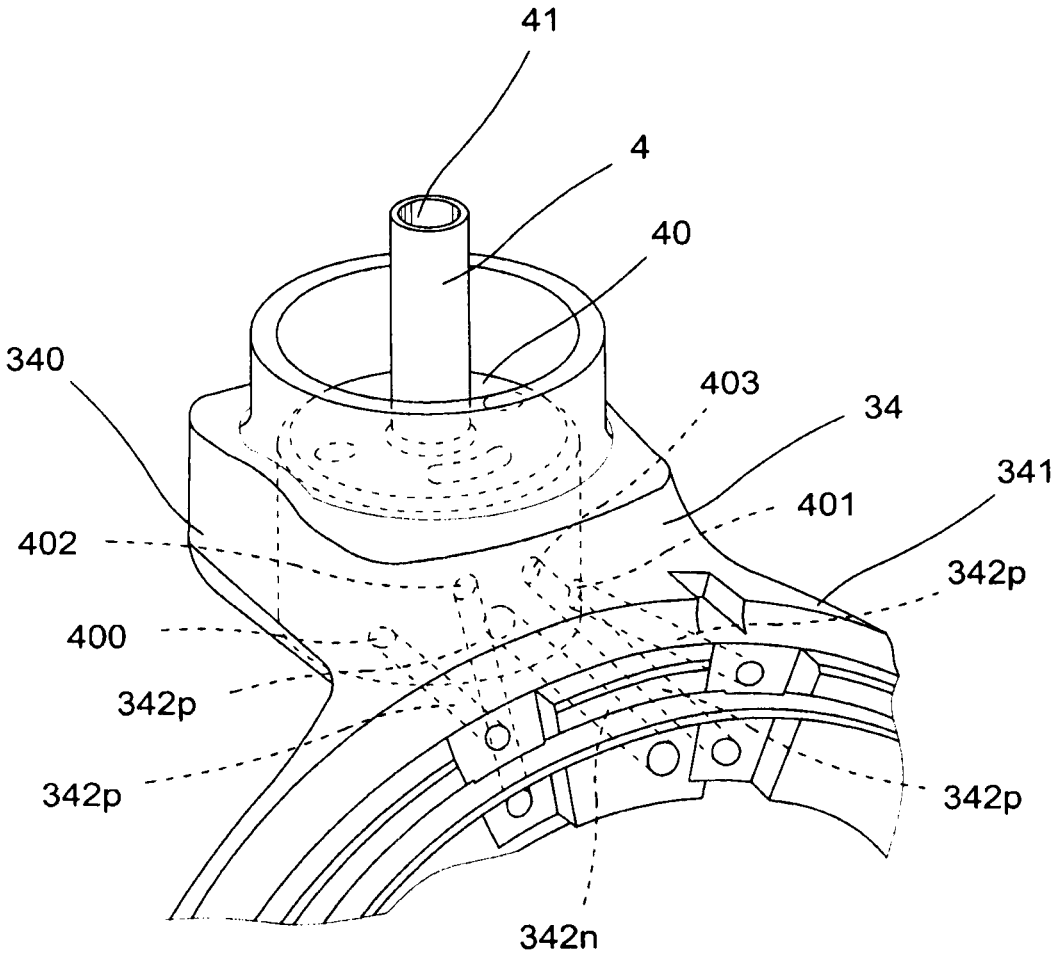
FIG. 3C is a perspective view of part of the injector according to FIG. 3A revealing the supply of fuel in two separate pilot and multipoint circuits.
Figure 3D:
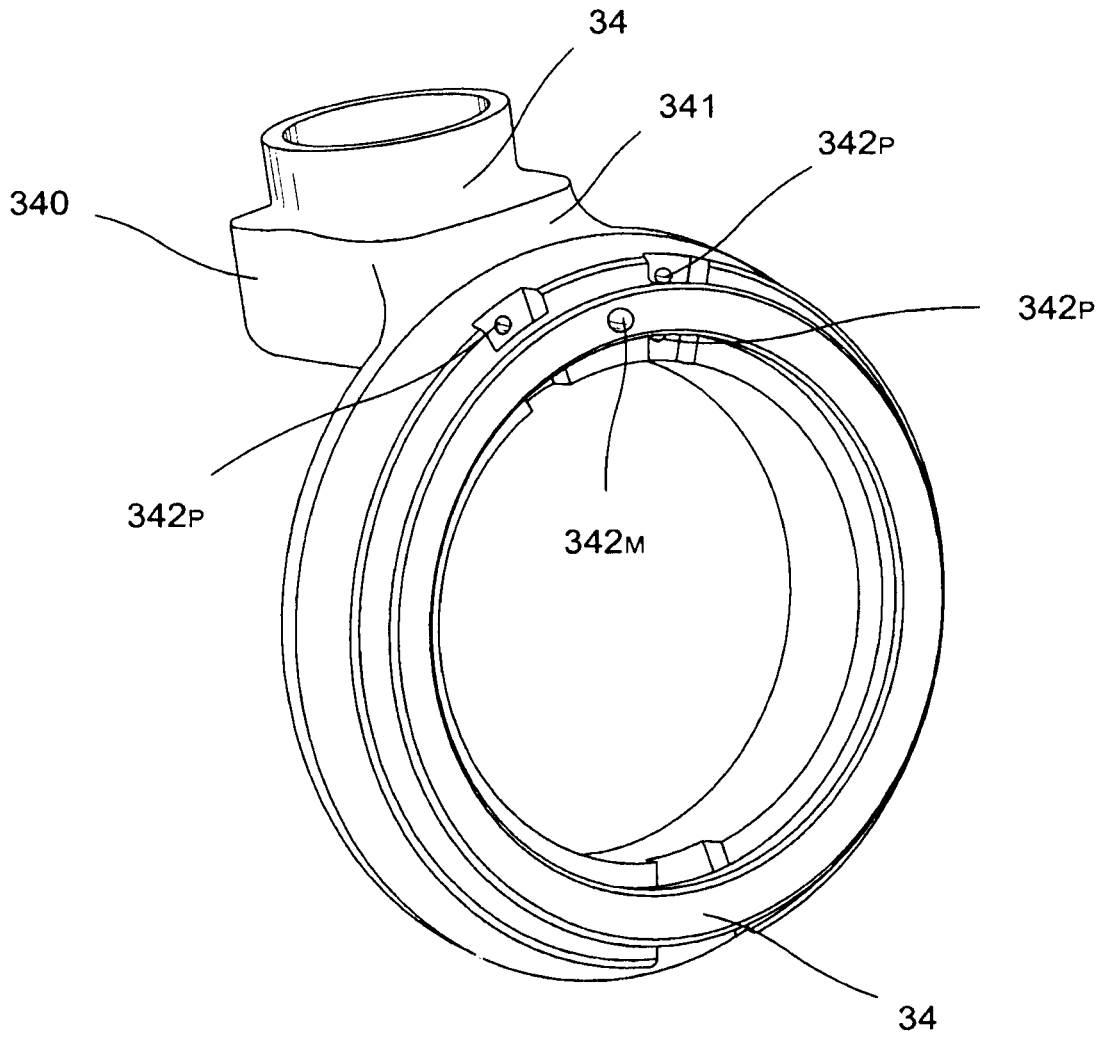
FIGS. 3D and 3E are perspective views of part of the injector according to FIG. 3A also showing the separate pilot and multipoint circuits.
Figure 3E:
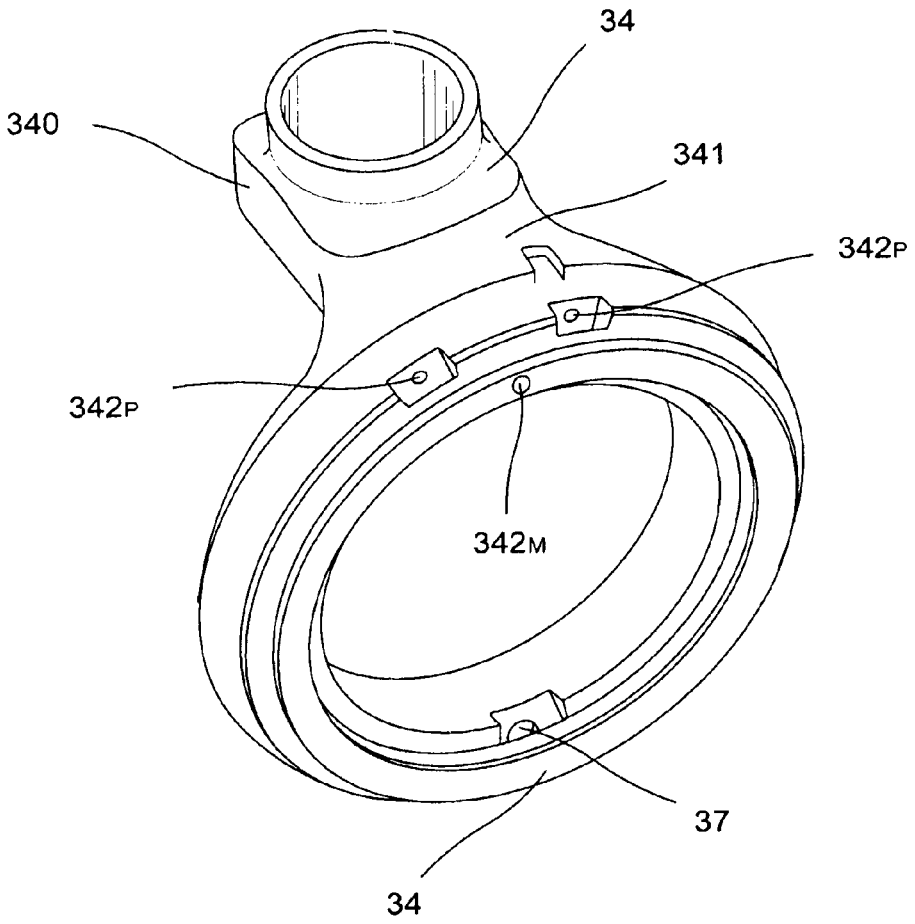

As illustrated in FIGS. 3 and 3A, the first 34 and second 35 ferrules are each formed by a one-piece machined part, with the second ferrule 35 in the form of a first hollow cylindrical ring 350: the baffles 360, 361, 362 are thus formed by the hollow cylindrical ring 350 and a further hollow cylindrical ring 380 housed inside the ring 350 by being soldered at that point. The base 380*a* of this further hollow cylindrical ring 380 is perforated with channels 3800 opposite the multipoint channels 351.

According to a preferred manufacturing method, the ferrule 35 is a one-piece part machined to form the hollow cylindrical ring 350, the other ring 380 also being a one-piece part 38 of dimensions adapted to be housed inside the large hollow cylindrical ring and machined. The two bases 380*a* are sealingly soldered to one another, then perforated simultaneously in order to obtain the multipoint injection channels 351, 3800. To obtain the first ferrule 34, a one-piece part is produced comprising a large solid cylindrical ring 343 and a small solid cylindrical ring 344 projecting axially relative to the large ring 343, the pilot 342*p* and multipoint 342*m* circulation channels are perforated in the solid cylindrical rings 343, 344, then the diameters of the solid perforated cylindrical rings 343, 344 are machined. Thus the first ferrule 34 is interlocked in the second ferrule 35, so as to achieve overlapping both between the large, solid and hollow rings 343, 350 and between the small, solid and hollow rings 344, 380, then the rings 343, 350, 344, 380 are sealingly soldered to one another.

According to the variant of FIGS. 3A and 3B, the admission chamber 37 is made in the first ferrule 34 and communicates with the injection nozzle 32 by means of a pipe 39 which does not pass through the swirler stage 31 or any space separating the swirlers from one another. Thus the peripheral pilot fuel circuit is connected to the axis I-I' of the injector 3 through the exterior of the injector head. Such a connection is advantageous as it may be obtained whatever the configuration of the swirlers 311, 311*a* (inclination, length, thickness, number of swirler stages, etc.). The pipe 39 is preferably connected, on the one hand, to the part of the admission chamber 37 opposite the part opening out from the peripheral baffles 361, 362 (FIG. 3B) and, on the other hand, to the part of the hub of the swirler stage 31 opposite and in communication with the housing of the injection nozzle 32 (FIG. 3A). As illustrated in FIGS. 3 and 3A, the pipe 39 is a tube bent in a U-shape, of which one of the branches 390 connected to the hub of the swirler stage 31 extends along the axis I-I' of the injection nozzle 32 and the other of the branches 391 connected in parallel to the admission chamber 37 extending parallel to the axis I-I' of the injection nozzle 32.

The swirlers of each stage 31, 31*a* may thus be swirlers 31 arranged in a helical manner relative to the axis I-I' of the injector and of uniform thickness over the width of the stage and advantageously reduced to a minimum. The injector 3 may comprise two stages 31, 31*a* of swirlers interlocked with said peripheral stage, itself interlocked in the internal opening of the ferrule 35 (FIG. 3).

In order to obtain separate circulation channels 342, a separate supply has to be produced upstream in the fuel supply. Thus a one-piece part 4 is provided forming a fuel distributor of which the body 40 is soldered to the inside of the connection 340 of the ferrule 34 and perforated by at least two separate channels 400, 401, 402, 403 each communicating, on the one hand, with the inside of the arm 30 connected to the pilot supply circuit and, on the other hand, with at least one pilot circulation channel 342*p*, perforated in the ferrule 34. The distributor 4 also comprises a duct 41 which extends inside the arm 30 and which is connected, on the one hand, to the multipoint supply circuit and, on the other hand, to a multipoint circulation channel 342*m* perforated in the first ferrule 34.

According to an advantageous variant of FIGS. 3C, 3D and 3E, the body 40 of the distributor 4 is perforated with four separate channels 400, 401, 402, 403 of which two 400, 401 each communicate with a pilot circulation channel 342*p* of the first ferrule, itself opening out onto the external peripheral baffle 361 and of which the two other channels 402, 403 each communicate with a pilot circulation channel 342*p* of the ferrule 34, itself opening out onto the internal peripheral baffle 362. In the construction of FIGS. 3C, 3D and 3E completely separate pilot supply channels 400, 401, 402, 403 are obtained for supplying the external peripheral baffle 361 and partially combined for supplying the internal peripheral baffle 362 by perforating a "bean" shaped hole. Thus an assembly is obtained of the duct 41 and supply channels 400, 401, 402, 403 which are produced with a minimal space requirement.

It goes without saying that further modifications may be implemented without departing further from the scope of the invention, namely to propose continuous cooling baffles which do not communicate with one another and which are arranged concentrically with the central multipoint baffle which is also continuous.

Thus a second ferrule 35 has been shown in the form of a one-piece part (FIG. 3A) in which venturis 500 and 501 are integrally formed. This makes it possible to avoid steps known as "aerodynamic" steps, which are obstacles in the region of the join between two parts located in the air flow.

A ferrule without venturis naturally falls within the scope of the invention.

The invention claimed is:

1. A method of manufacturing a ferrule intended to be assembled in a multipoint fuel injector, wherein multipoint injection channels are perforated on a periphery of the ferrule, the method comprising:

machining a first one-piece part in order to obtain a large hollow cylindrical ring;

machining a second one-piece part in order to obtain a small hollow cylindrical ring of dimensions adapted to be housed inside the large hollow cylindrical ring;

sealed soldering between two bases of the hollow rings; and simultaneously perforating the two hollow rings soldered to one another in order to obtain multipoint injection channels.

2. A method of manufacturing a multipoint fuel injector comprising: a first ferrule; and a second ferrule manufactured as claimed in claim 1, the method comprising:

producing another one-piece part comprising a large solid cylindrical ring and a small solid cylindrical ring projecting axially relative to the large solid cylindrical ring;

perforating pilot and multipoint circulation channels in the solid cylindrical rings;

machining of diameters of the solid cylindrical rings, perforated in order to obtain the first ferrule;

interlocking of the first ferrule in the second ferrule so as to achieve overlapping both between the large solid and hollow rings and between the small solid and hollow rings; and sealed soldering of the rings to one another.

* * * * *